US012534286B2

(12) United States Patent
Nervo et al.

(10) Patent No.: US 12,534,286 B2
(45) Date of Patent: Jan. 27, 2026

(54) DEVICE FOR DISPENSING A MATERIAL BY MEANS OF PRESSURIZED GAS AND PARTIALLY GAS-FILLED TUBULAR BODY FOR USE THEREIN

(71) Applicant: Dispensing Technologies B.V., Eindhoven (NL)

(72) Inventors: Paulo Nervo, Hoogeloon (NL); Dennis Van Melick, Eindhoven (NL); Dominicus Jan Van Wijk, Helmond (NL)

(73) Assignee: DISPENSING TECHNOLOGIES B.V., Eindhoven (NL)

( * ) Notice: Subject to any disclaimer, the term of this patent is extended or adjusted under 35 U.S.C. 154(b) by 0 days.

(21) Appl. No.: 17/927,778

(22) PCT Filed: May 25, 2021

(86) PCT No.: PCT/NL2021/050328
§ 371 (c)(1),
(2) Date: Nov. 25, 2022

(87) PCT Pub. No.: WO2021/242094
PCT Pub. Date: Dec. 2, 2021

(65) Prior Publication Data

US 2023/0227239 A1 Jul. 20, 2023

(30) Foreign Application Priority Data

May 25, 2020 (NL) ..... 2025666
Oct. 27, 2020 (NL) ..... 2026776

(51) Int. Cl.
*B65D 83/38* (2025.01)
*B65D 83/285* (2025.01)
*B65D 83/64* (2006.01)

(52) U.S. Cl.
CPC ..... *B65D 83/382* (2013.01); *B65D 83/285* (2013.01); *B65D 83/64* (2013.01)

(58) Field of Classification Search
CPC .. B65D 83/285; B65D 83/64; B65D 51/2864; B65D 51/2871; B65D 51/2892;
(Continued)

(56) References Cited

U.S. PATENT DOCUMENTS 2,597,715 A 5/1952 Erikson
3,081,006 A * 3/1963 Land ..... B65D 47/2018 222/491

(Continued)

FOREIGN PATENT DOCUMENTS

DE 4132422 A1 4/1993
EP 2930125 A1 10/2015
WO 2007010561 A1 1/2007

OTHER PUBLICATIONS

Clamp Definition & Meaning—Merriam-Webster.pdf; obtained on Aug. 15, 2025 from: https://www.merriam-webster.com/dictionary/clamp.*

(Continued)

*Primary Examiner* — Paul R Durand
*Assistant Examiner* — Randall A Gruby
(74) *Attorney, Agent, or Firm* — KDW Firm PLLC

(57) ABSTRACT

A device for dispensing a material includes a reservoir for the material and an outlet channel connectable thereto. The reservoir has a tubular body partially filled with pressurized gas and partially filled with the material to be dispensed. One end of the tubular body is welded shut and an opposite end is closed by a sealing member extending over at least part of a cross-sectional area of the tubular body. The sealing member is arranged in a sleeve connected to the end of the tubular body opposite the welded end thereof. The sealing (Continued)

member has a pierceable diaphragm and the device may further comprise a piercing member. The sealing member can include a movable valve or can be removably fixed inside the tubular body and the device can include an operating member. The tubular body and the piercing member or operating member, respectively, may be movable towards each other.

15 Claims, 7 Drawing Sheets

(58) Field of Classification Search
CPC ..... B65D 83/48; B65D 83/50; B65D 83/60; B65D 83/62
USPC .... 220/203.04, 203.01, 202, 203.22, 203.19, 220/203.07
See application file for complete search history.

(56) References Cited

U.S. PATENT DOCUMENTS 3,260,411 A * 7/1966 Dobson ..... B65D 35/12 222/541.2
3,355,238 A * 11/1967 Schwartzman ..... B65D 47/248 401/41
3,441,177 A * 4/1969 Treharne, Jr. ..... B65D 83/48 222/82
3,592,365 A * 7/1971 Schwartzman .... B65D 47/2075 222/386.5
3,648,899 A * 3/1972 Lukesch ..... B65D 83/687 222/82
3,669,323 A * 6/1972 Harker ..... B65D 47/2031 222/490
3,700,513 A * 10/1972 Haberhauer et al. .. B65D 35/06 156/203
4,060,179 A * 11/1977 McGhie ..... B65D 35/12 220/613
4,134,523 A * 1/1979 Hansen ..... B65D 83/64 138/42
4,448,829 A * 5/1984 Kohler ..... B65D 35/12 428/35.8
4,450,985 A * 5/1984 Beard ..... B65D 83/14 222/83.5
4,548,338 A * 10/1985 Sander ..... B65D 35/12 222/107
4,792,061 A * 12/1988 Nishida ..... B65D 35/12 222/107
4,844,301 A * 7/1989 Juillet ..... B65D 83/62 222/509
5,275,311 A * 1/1994 Piarrat ..... B65D 35/14 222/105
5,638,874 A * 6/1997 Thompson ..... B60K 15/03519 141/286
5,962,096 A * 10/1999 Smith ..... B05B 11/1046 222/215
6,041,969 A * 3/2000 Parise ..... B05B 11/0078 222/129
6,170,705 B1 * 1/2001 Schneider ..... B65D 47/122 222/569
8,383,215 B2 * 2/2013 Shi ..... B65D 35/12 428/34.1
8,413,802 B2 * 4/2013 Lee ..... B65D 51/2864 206/219
8,906,187 B2 * 12/2014 Miller ..... B32B 7/12 156/303.1
8,944,271 B2 * 2/2015 Seguin ..... B65D 51/225 220/258.4
9,457,937 B2 * 10/2016 Ichikawa ..... B65D 51/10
9,463,906 B2 * 10/2016 Kerman ..... B32B 15/085
9,493,273 B2 * 11/2016 Julien ..... B65D 41/0414
9,957,086 B2 * 5/2018 Kerman ..... B65D 23/00
11,603,257 B2 * 3/2023 Sugawara ..... B65D 83/42
12,280,939 B2 * 4/2025 Sugawara ..... B65D 83/382
2012/0205404 A1 * 8/2012 Massey ..... B65D 35/24 222/107
2014/0131056 A1 5/2014 Edwards
2014/0190973 A1 * 7/2014 Kerman ..... B65D 35/44 220/278
2015/0122845 A1 * 5/2015 Uetake ..... A61F 9/0008 222/189.06
2019/0112107 A1 * 4/2019 Fernández De Mendiola Quintana ..... B65D 35/24
2020/0047952 A1 * 2/2020 Tanaka ..... B29C 66/83221

OTHER PUBLICATIONS

Engagement Definition & Meaning—Merriam-Webster.pdf; obtained on Aug. 15, 2025 from: https://www.merriam-webster.com/dictionary/engagement.*
International Search Report and Written Opinion, dated Sep. 27, 2021, for Application No. PCT/EP2021/050328, (15 pages).

* cited by examiner

DEVICE FOR DISPENSING A MATERIAL BY MEANS OF PRESSURIZED GAS AND PARTIALLY GAS-FILLED TUBULAR BODY FOR USE THEREIN

This application is a national stage filing under 35 U.S.C. 371 of pending International Application No. PCT/NL2021/050328, filed May 25, 2021, which claims priority to Netherlands Patent Application No. 2025666, filed May 25, 2020, and which also claims priority to Netherlands Patent Application No. 2026776, filed Oct. 27, 2020, the entirety of which applications are incorporated by reference herein.

The invention relates to a device for dispensing a material, comprising a reservoir for the material and an outlet channel connectable to the reservoir, wherein the reservoir comprises a tubular body partially filled with pressurized gas and partially filled with the material to be dispensed. Such a dispensing device is disclosed in the applicant's earlier patent application WO 2020/109340 A1, which was published after the effective filing date of this application.

A gas-filled body for use in the earlier application can be a single layer or multi-layer extruded tube of which the ends have been closed after the tube has been filled with gas. Alternatively, the tubular body can be made of a single layer of foil or a foil laminate. The tubular body can also be made by injection molding or blow molding. The gas-filled tubular body can be made of plastics that can be easily recycled, like e.g. PE or PP.

The dispensing device proposed in the above-identified patent application is structurally simple and may be manufactured at low cost. It has a limited number of parts, so that it may be assembled in a quick and simple manner. Moreover, such a dispensing device does not require venting when the material is dispensed, and the propellant gas ensures a homogenous distribution of the material to be dispensed.

The present invention has for its object to propose further improvements to a dispensing device of the type discussed above. In accordance with the invention this is achieved by the fact that one end of the tubular body is welded shut and an opposite end of the tubular body is closed by a sealing member extending over at least part of a cross-sectional area of the tubular body, wherein the sealing member is arranged in a sleeve which is connected to the end of the tubular body opposite the welded end thereof.

Such a sealing element offers more opportunities for connecting an outlet channel to the reservoir than an end of the tube that is simply welded shut. The design of the sealing element may be varied to accommodate different arrangements of the outlet channel. The sleeve may serve as an adapter for connecting the tubular body to the outlet channel and to further parts of the dispensing device. In addition, the sleeve may serve as an engagement part where the reservoir may be gripped, so that the reservoir may be handled without exerting any external pressure on the tubular body.

The structure and materials of the partially gas-filled tubular body can be the same as described above in connection with the earlier application. In addition, the sealing member and the sleeve may also be made of plastic materials, preferably materials which are compatible with the plastic of the tubular body. In this way a structurally simple and low-cost dispensing device is obtained, which may be easily recycled after use.

According to the requirements of a particular use the sealing member may be fixed to the tubular body by clamping, welding, or through an adhesive.

When the sleeve has an inner part supporting the sealing member and configured to be arranged inside the end of the tubular body opposite the welded end thereof, and an outer part configured to be arranged around the end of the tubular body and to be connected to the inner part, the tubular body may be easily fixed between the inner and outer parts of the sleeve.

In order to form a connection without having to stress the tubular body, the inner and outer parts of the sleeve may be configured to protrude past an edge bounding the end of the tubular body and to be connected to each other. The sealing member may be arranged at or near the edge of the tubular body, so that it is recessed with respect to the protruding inner and outer sleeve parts.

In this way the sealing member is protected from external influences which might lead to inadvertent opening of the tubular body.

If the dispensing device is intended for single use, the sealing member may comprise a pierceable diaphragm and the device may further comprise a piercing member, the tubular body and the piercing member being movable towards each other. Piercing the sealing member is a simple way of gaining access to the interior of the tubular body and dispensing its contents.

In an embodiment of the dispensing device which is structurally simple, the piercing member may be connected to the outlet channel. In order to minimize the number of separate parts the piercing member may form an integral part of the outlet channel.

If the dispensing device is intended for repeated use, the sealing member may comprise a movable valve and the device may further comprise an operating member, the tubular body and the operating member being movable towards each other. Such a movable valve may be opened to allow part of the material to be dispensed from the tubular body, and may then be closed again to maintain the gas pressure in the tubular body for dispensing more of the material upon renewed actuation of the valve.

In order to simplify operation of the dispensing device, the valve may be biased to a position closing the end of the tubular body. In this way the valve will always return to its closed position after dispensing part of the material from the tubular body. The valve may be biased by the internal pressure in the tubular body, but the valve may also be elastically deformable or may be engaged by a biasing member, e.g. a spring.

In another embodiment of the dispensing device for single use, the sealing member may be removably fixed inside the tubular body and the device may further comprise an operating member, the tubular body and the operating member being movable towards each other. By breaking the fixed connection between the periphery of the sealing member and the tubular member, e.g. by using the operating member to push the sealing member into the tubular body, access may be gained to the interior of the tubular body and its contents may be dispensed until it is empty. The sealing member can be left to move freely in the interior of the tubular body.

In an embodiment of the dispensing device which is structurally simple, the operating member may be connected to the outlet channel. In order to minimize the number of separate parts the operating member may be integrally formed with the outlet channel.

In an embodiment of the dispensing device, the outlet channel may form part of a nozzle or applicator that is connectable to the reservoir. In this way the dispensing device may simply be formed by a tubular body filled with gas and the material to be dispensed, and a nozzle or applicator connected to the tubular body.

When the sealing member is arranged in a sleeve, the nozzle or applicator may be connectable to the sleeve. In this way a robust yet simple connection between the tubular body and the nozzle or applicator may be obtained. The sleeve may be configured for connection to a specific type of nozzle or applicator, but may also include standard connecting means, e.g. a standard size interior or exterior thread.

In an embodiment of the dispensing device, the pressurized gas in the tubular body may be separated from the material to be dispensed. In this way the dispensing device may be used in any orientation, since there is no risk that the gas will collect at the outlet channel. Moreover, separating the gas from the material to be dispensed allows highly viscous liquids and even granular solids like powders to be dispensed by the gas pressure.

In an embodiment of the dispensing device, a piston may be slidably arranged in the tubular body to separate the pressurized gas from the material to be dispensed, wherein the pressurized gas may fill a part of the tubular body between the piston and the welded end, and the material to be dispensed may fill a part of the tubular body between the piston and the sealing member. In this way the piston serves to direct the gas pressure towards the outlet channel, thus facilitating dispensing. Moreover, this arrangement ensures that the gas is retained in the reservoir while the material is being dispensed, thus preventing a user from inadvertently ingesting or inhaling gas in situations where the material is intended to be consumed or inhaled.

In another embodiment of the dispensing device, the tubular body may comprise an inner tubular body filled with the material to be dispensed and an outer tubular body surrounding the inner tubular body and filled with the pressurized gas. In this way the reservoir may be separately filled with the gas and the material to be dispensed, which simplifies the filling process. Moreover, tolerances during manufacture of the tubular body may be less strict than for a slidable piston, where sealing is an issue. This embodiment further allows the properties of the inner and outer tubular bodies to be optimized for their respective functions. For instance, the material for the outer tubular body may be selected to have excellent gas barrier properties, whereas the inner tubular body may include a material that forms a excellent liquid barrier. Moreover, in this arrangement there is no risk of the outer tubular body coming into contact with e.g. a liquid material to be dispensed, which could affect its gas barrier properties. And finally, in this arrangement the reservoir looks properly filled, since the inner tubular body extends over substantially the entire height of the reservoir, whereas in other embodiments the gas occupying part of the reservoir may give the impression that the reservoir is not completely filled.

In a further embodiment the inner tubular body may have a diameter which is so much smaller than that of the outer tubular body, that an annular space is defined between the inner and outer tubular bodies, and this annular space may be filled with the pressurized gas. In such an arrangement the gas exerts a radially directed pressurize on the inner tubular body over its entire length, thus pressurizing the material to be dispensed.

In another embodiment the inner tubular body has substantially the same diameter as the outer tubular body, but a smaller length than the outer tubular body. In this embodiment the pressurized gas may be received in a space between the welded end of the inner tubular body and the welded end of the outer tubular body. The welded end of the inner tubular body may thus effectively form the separation between the gas in the outer tubular body and the material to be dispensed in the inner tubular body. This arrangement functions more or less in the same way as the embodiment with the slideable piston. The gas exerts pressure on the welded end of the inner tubular body which serves to urge the material to be dispensed towards the end that is closed by the sealing member, and the tight fit between the inner tubular member and the outer tubular member serves as a seal which prevents gas from escaping from the reservoir when the material is being dispensed. Moreover, since the pressurized gas is trapped in a space that is bounded by a relatively small surface area of the outer tubular body, there is less risk of gas permeating from the outer tubular body.

When the tubular body tapers towards the end that is closed by the sealing member, the open end may be closed by a smaller sealing member, which is subject to lower loads because the gas pressure acts on a smaller surface area. This allows the structure of the sealing member to be lighter and simpler than a full size sealing member.

In addition or alternatively, the tubular body tapers towards the end that is welded shut. In this way the forces acting on the weld are smaller, which allows a weaker and therefore thinner and lighter weld, or conversely a higher gas pressure for a weld of a given strength.

Just like in the earlier application, the tubular body may be made of a flexible material so as to be resilient. Such resilience may be the result of the flexibility of the body, supported by the pressure of the gas with which it is filled.

And finally, the invention also relates to a tubular body for use in a dispensing device as described above.

The invention will now be illustrated by way of a number of exemplary embodiments, with reference being made to the annexed drawings, in which similar elements are identified by the same reference numerals, and in which.

Figure 1:
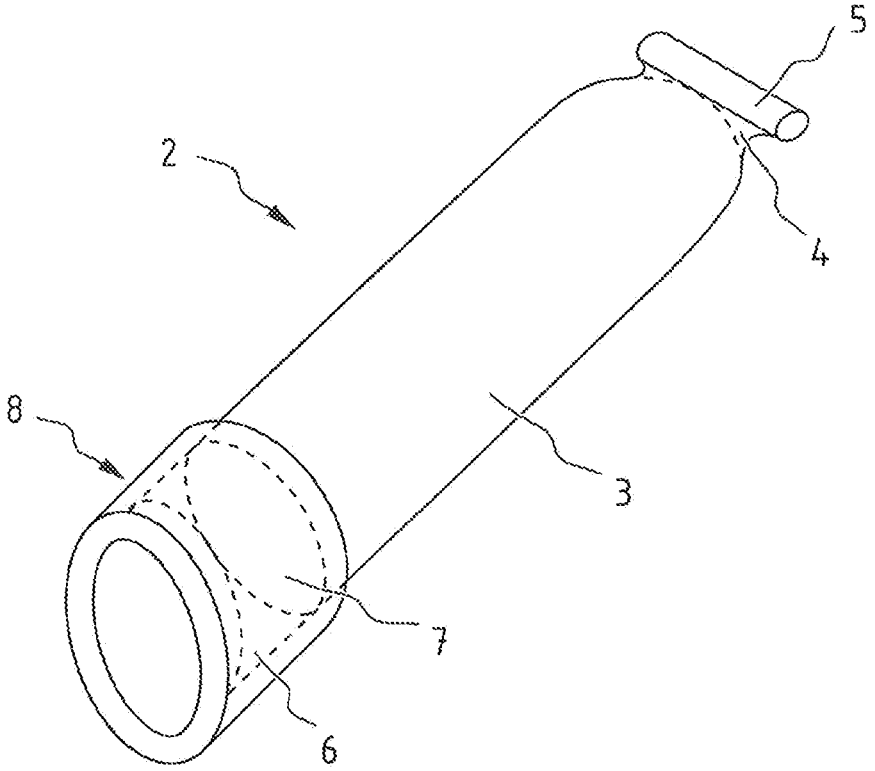
FIG. 1 is a perspective view of a reservoir for a dispensing device in accordance with an embodiment of the invention.
Figure 2:
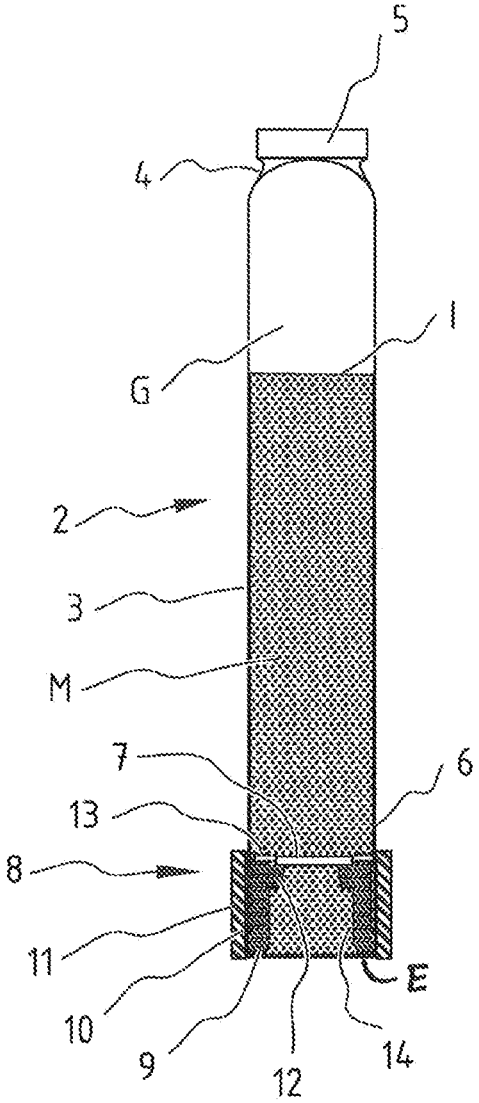
FIG. 2 is a longitudinal sectional view along the line II-II in FIG. 1, showing the reservoir partially filled with gas and partially filled with a material to be dispensed, and ready for use.

A reservoir 2 for a device 1 for dispensing a material M comprises a tubular body 3 having one end 4 shut by a weld 5 and an opposite end 6 closed by a sealing member 7 which extends over the cross-sectional area of the tubular body 3 (FIG. 1). The tubular body 3 is partially filled with pressurized gas G and partially filled with the material M to be dispensed (FIG. 2). The gas G and material M are in contact at an interface I, which moves as the orientation of the reservoir 2 changes, since the gas, being lighter than the material M, will collect in the upper part of the reservoir. When the reservoir 2 is held upright as shown in FIG. 2, the gas G will be in the part of the tubular body 3 that is welded shut, while the material M will be in the part of the tubular body 3 that is closed by the sealing member 7.

In the illustrated embodiment the sealing member 7 is arranged in a sleeve 8 which is connected to the end 6 of the tubular body 3. The sleeve 8 has an inner part 9 supporting the sealing member 7. This inner part 9 is arranged inside the end 6 of the tubular body 3 and protrudes past an edge 10 bounding this end 6. The sleeve 8 further has an outer part 11 which is arranged around the outside of the end 6 of the tubular body 3, and which also protrudes past the edge 10. The protruding segments of the inner and outer parts 9, 11 are connected to each other.

In the illustrated embodiment the inner part 9 has a shoulder 12 which supports a peripheral portion of the sealing member 7 and a fixation element 13 for clamping the peripheral portion of the sealing member 7 against the shoulder 12. In this way the sealing member 7 is recessed with respect to an end plane E of the sleeve 8. A segment 14 of the inner portion 9 which extends from the shoulder 12 outwards may serve as an adapter for receiving an outlet channel to be discussed below.

The shape and dimensions of the sleeve 8 may be varied independently of the shape and dimensions of the tubular body 3 to accommodate various types of outlet channel and different nozzles and applicators, as will be discussed below.

Figure 3:
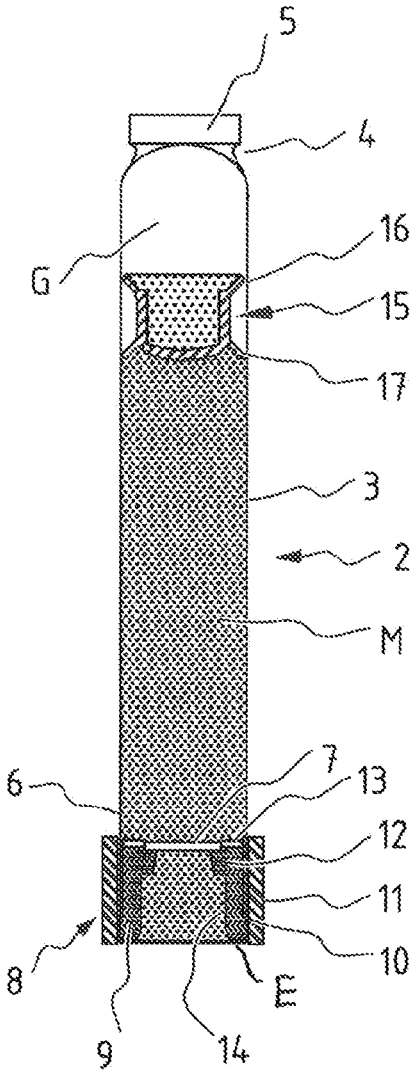
FIG. 3 is a view corresponding with that of FIG. 2 of another embodiment of the reservoir, in which the gas and the material to be dispensed are separated by a slidable piston.

In another embodiment of the reservoir 2 the gas G and material M are separated by a piston 15 which is slidably arranged in the tubular body 3 (FIG. 3). As shown here the piston has double sealing edges 16, 17 which are elastic and closely conform to the inner surface of the tubular body 3 to prevent any leakage of gas past the piston, but other configurations are also conceivable. This embodiment is suitable when the material M to be dispensed is a highly viscous liquid or even a powder. The gas G is trapped in the part of the tubular body 3 between the piston 15 and the welded end 4, and forces the piston 15 in the direction of the opposite end 6. The material M is contained between the piston 15 and the sealing member 7, and may be dispensed as soon as the sealing member 7 is removed to free the open end 6 of the tubular body 3. This embodiment can be used in any orientation, since the piston 15 ensures that the gas G remains trapped and the material M is always at the dispensing end of the reservoir 2, i.e. the end 6 which will be opened by either piercing or moving the sealing member. Because the gas G remains trapped, this embodiment is suitable for dispensing materials which are to be consumed or inhaled.

Figure 4:
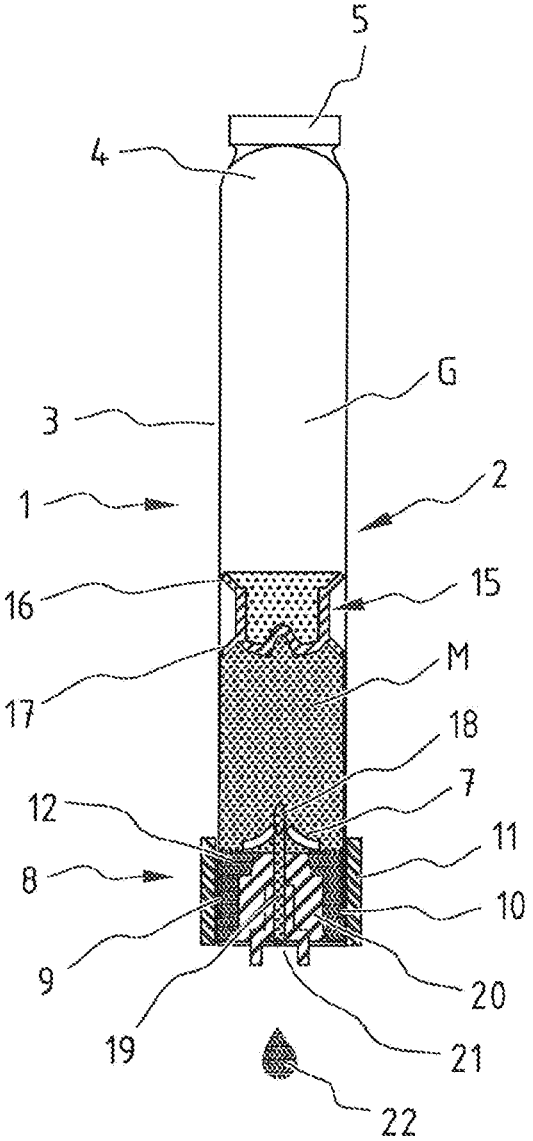
FIG. 4 is a view corresponding with FIG. 3 and showing the dispensing device during use, in which the sealing member has been pierced and an outlet channel is connected thereto.

As shown somewhat schematically in FIG. 4, the sealing member 7 may be a diaphragm that may be pierced by a piercing member 18 which is connected to an outlet channel 19. In this embodiment the piercing member 18 and outlet channel 19 form part of the dispensing device 1. They may be separate from the reservoir 2 or they may be movably connected to the sleeve 8. The diaphragm may be made of an elastic material, so that it sealingly fits around the piercing member 18, preventing any material from escaping around this piercing member. Alternatively, the diaphragm may be made of a non-elastic material that is ruptured after piercing. In that case material M could freely flow out of the reservoir over a large part of its cross-section.

In the illustrated embodiment the piercing member 18 is formed by a sharp point of the outlet channel 19, which is embodied as a hollow needle. The outlet channel 19 is arranged in a body 20 which is fittingly accommodated in the inner part 9 of the sleeve 8 and which has an outflow opening 21 at the end of the outlet channel. As a result of the gas pressure acting on it, the piston 15 moves towards the end 6 and pushes the material M out of the tubular body 3 through the outlet channel 19, as schematically represented by a drop 22.

Figure 5A:
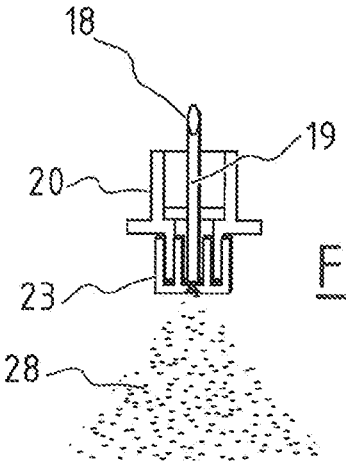
FIG. 5A shows a longitudinal sectional view of an outlet channel that forms part of a spraying or foaming nozzle.

Instead of a regular outflow opening, the outlet channel may debouch in a nozzle 23 from which the material can be dispensed in the form of a spray or foam cone 28 (FIG. 5A). The nozzle 23 is arranged on a body 20 which can be connected to the adapter 14 of the inner sleeve part 9. For instance, the body 20 may be externally threaded and the inner sleeve part 9 may be internally threaded, or the body 20 and inner sleeve part 9 may have bayonet provisions.

Figure 5B:
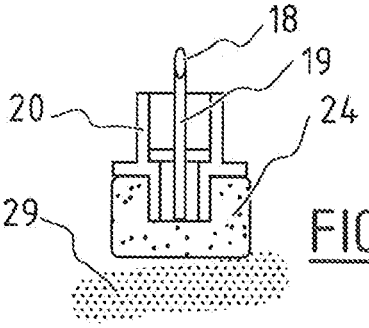
FIG. 5B is a view corresponding with FIG. 5A of the outlet channel as part of a sponge-like applicator.
Figure 5C:
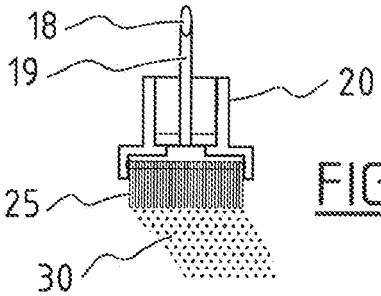
FIG. 5C is a view corresponding with FIGS. 5A and 5B of the outlet channel as part of a brush-type applicator.

Alternatively, the body 20 may carry an applicator into which the outlet channel 19 debouches. This applicator may be a sponge-like applicator 24 which may distribute the dispensed material M over a relatively wide area 29 (FIG. 5B), or may have the form of a brush 25, which may similarly distribute the material M over a relatively wide stroke 30 (FIG. 5C). Obviously, other arrangements are also conceivable.

Figure 6:
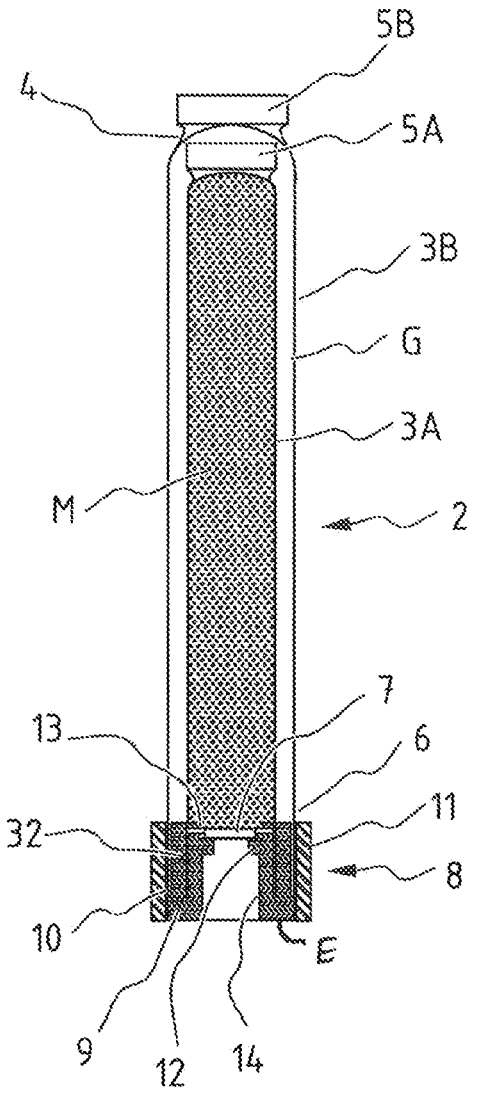
FIG. 6 is a view corresponding with that of FIGS. 2 and 3 of another embodiment of the reservoir in which the material to be dispensed is packed in an inner tubular body and the gas is contained in an outer tubular body.

Instead of movable piston, another way to separate the gas G and material M is by providing two concentric compartments in the reservoir 2. This can be done by packing the material M in an inner tubular body 3A and containing the pressurized gas G in an outer tubular body 3B which has a larger diameter and surrounds the inner body (FIG. 6). Each of the tubular bodies 3A, 3B is again welded shut at one end 4, while the opposite end 6 of the inner tubular body 3A is closed by a sealing member 7. The annular space between the inner and outer tubular bodies 3A, 3B is closed at that end by a sleeve 8 which supports the sealing member 7. In this case the outer tubular member 3B is fixed between an outer part 11 and an inner part 9 of the sleeve 8, while the inner tubular member 3A is fixed in an annular slot in the inner sleeve part 9. The outer tubular body 3B may have optimized gas barrier properties, while the inner tubular body may have optimized liquid barrier properties—in case the material to be dispensed is a liquid. The gas G in the annular space between the inner and outer tubular bodies 3A, 3B exerts pressure in radial direction on the material M to be dispensed from the inner tubular body 3A.

Figure 7:
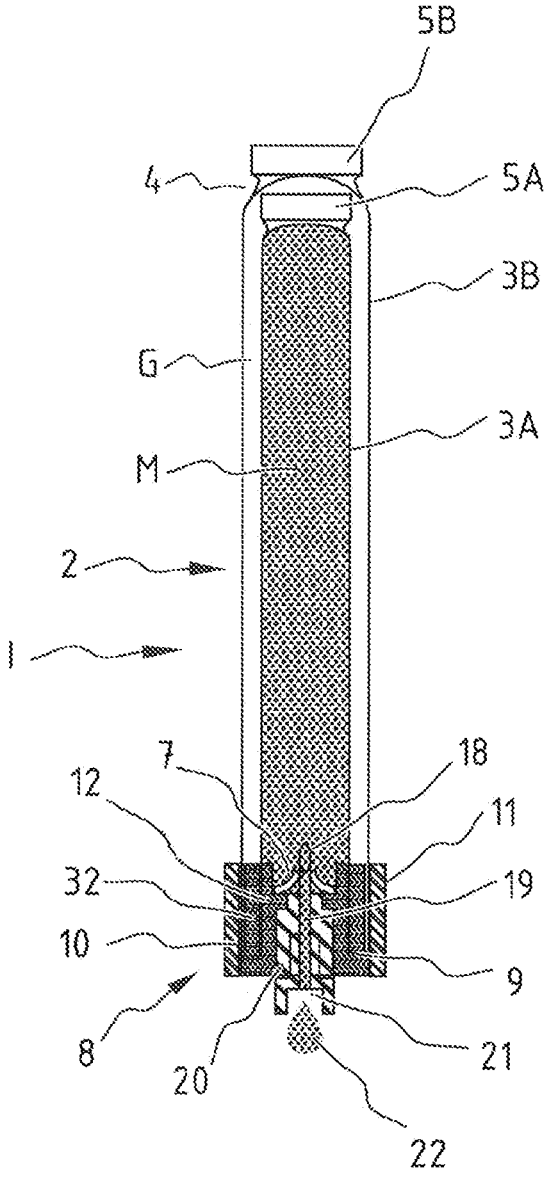
FIG. 7 is a view corresponding with FIG. 6 and showing the dispensing device at the beginning of use, with the sealing member having been pierced and an outlet channel connected thereto.
Figure 8:
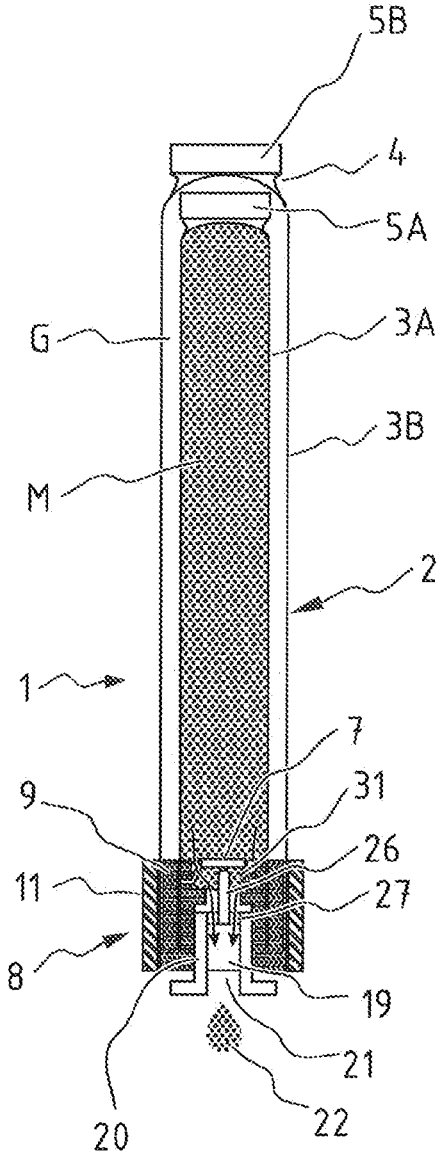
FIG. 8 is a view corresponding with FIG. 7 and showing yet another embodiment of the dispensing device, in which the sealing member comprises a movable valve.

As shown in FIG. 7, the sealing member 7 can be a pierceable diaphragm in this embodiment as well. However, instead of such a diaphragm, the sealing member 7 could comprise a valve which is movable between a closed position as shown in FIG. 6 and an open position as shown in FIG. 8. In this way the flow of material M can be interrupted so as to provide a controllable dispensing device 1. Movement of the valve from its closed to its open position can be effected by an operating member 26 which may engage the valve. The operating member 26 is connected by arms 27 to an outlet channel 19, which in this embodiment is defined by a sidewall of body 20 and debouches in outflow opening 21. When the body 20 is disconnected from the adapter 14 of the inner sleeve part 9, the operating member 26 is disengaged from the valve. Here again, the operating member 26 and outlet channel 19 may form part of the dispensing device 1, either separate from the reservoir 2 or movably connected to the sleeve 8.

In the illustrated embodiment the movable valve is biased to its closed position at least by the gas pressure acting on the inner tubular body 3A containing the material M, which in turn transfers this pressure to the valve. In order to achieve rapid closing of the valve, it may additionally be biased by mechanical means, e.g. spring force. In the shown embodiment the valve is connected to the inner sleeve part 9 by flexible arms 31 which urge the valve back to its closed position to interrupt the flow of material M out of the reservoir.

Alternatively, the valve could be permanently held in its open position against the pressure acting on the material M. To this end the valve, when being opened by the operating member 26, could be moved past a cam, ridge or other obstacle that will render a return movement of the valve impossible.

Figure 9A:
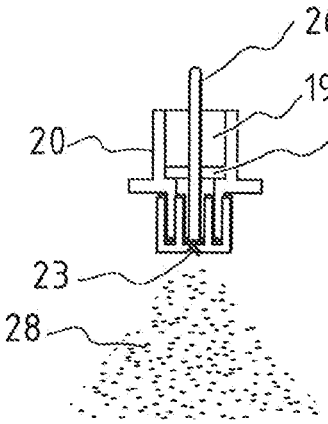
FIG. 9A shows a longitudinal sectional view of an operating member that forms part of a spraying or foaming nozzle.
Figure 9B:
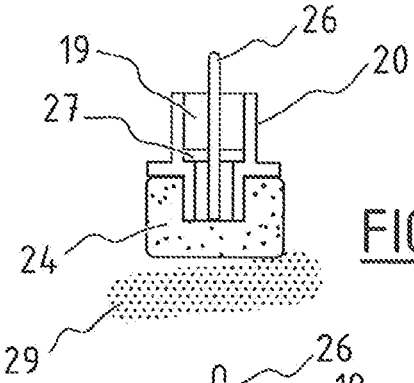
FIG. 9B is a view corresponding with FIG. 9A of the operating member as part of a sponge-like applicator.
Figure 9C:
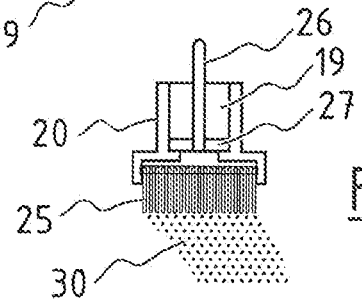
FIG. 9C is a view corresponding with FIGS. 9A and 9B of the operating member as part of a brush-type applicator.

Here again, the outlet channel 19 could also debouch in a nozzle 23 to form a spray or foam cone 28 (FIG. 9A), a sponge-like applicator 24 to cover a wide area 29 (FIG. 9B) or a brush-type applicator 25 to form a brushstroke 30 (FIG. 9C).

Instead of being formed by a pierceable diaphragm or a movable valve, the sealing member 7 could also be removably arranged in the inner part 9 of the sleeve 8. For instance, the sealing member 7 could have its peripheral portion clamped in the inner sleeve part 9 such that it can be permanently removed by forcing it out of the clamping engagement. The sealing member 7 could e.g. be a spherical body clamped in a circumferential groove in the inner sleeve part 9. This spherical body could then be pushed inward into the tubular body by means of an operating member, after which it could be left to float inside the tubular body 3.

Figure 10:
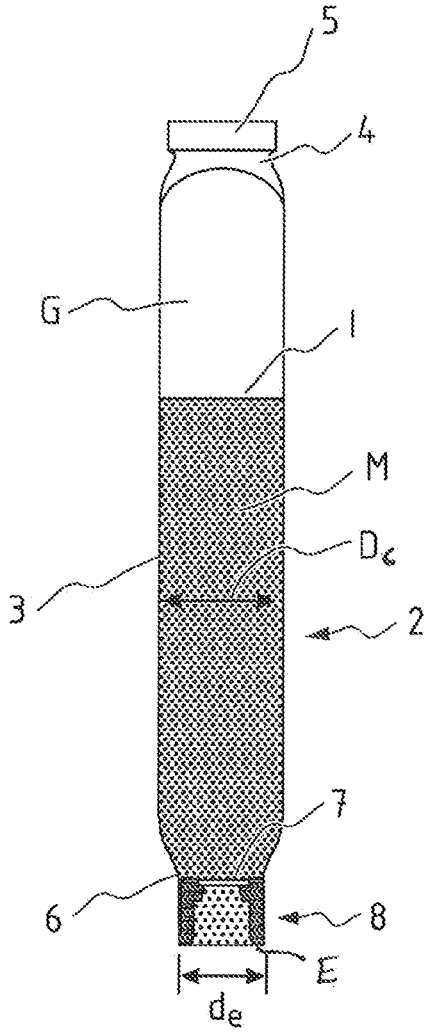
FIG. 10 is a view corresponding with that of FIG. 2 of yet a further embodiment of the reservoir, in which the tubular body tapers towards the end that is closed by the sealing member.

In an embodiment of the invention, the tubular body 3 may taper towards the end 6 that is closed by the sealing member 7 (FIG. 10). In this way the open end 6 has a diameter $d_e$ that is smaller than the diameter $D_c$ of the cylindrical part of the tubular body 3, which allows a smaller sealing member 7 to be used. This sealing member 7, which is subject to lower loads because the gas pressure acts on a smaller surface area, may be lighter and simpler than the sealing member of any of the other embodiments.

Figure 11:
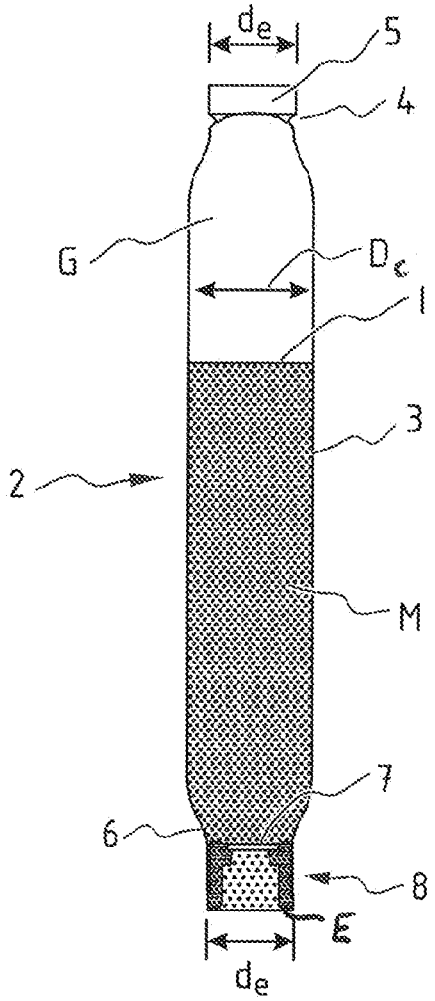
FIG. 11 is a view corresponding with that of FIG. 10 of an alternative embodiment of the reservoir, in which the tubular body tapers towards both ends.

In similar fashion, the tubular body 3 may also taper towards the welded end 4 (FIG. 11). Here again, because the gas pressure acts on a smaller surface area, loads acting on the weld 5 are smaller and the weld may be thinner and lighter. Conversely, a tubular body 3 having a tapered end 4 may allow higher gas pressures for given dimensions and strength of the weld 5, which is determined at least to some extent by the wall thickness of the tubular body 3.

And although in this embodiment both ends of the tubular body 3 have a reduced diameter $d_e$, it is also conceivable that only the welded end 4 is tapered, and the end 6 closed by the sealing member 7 has the full diameter $D_c$.

Figure 12:
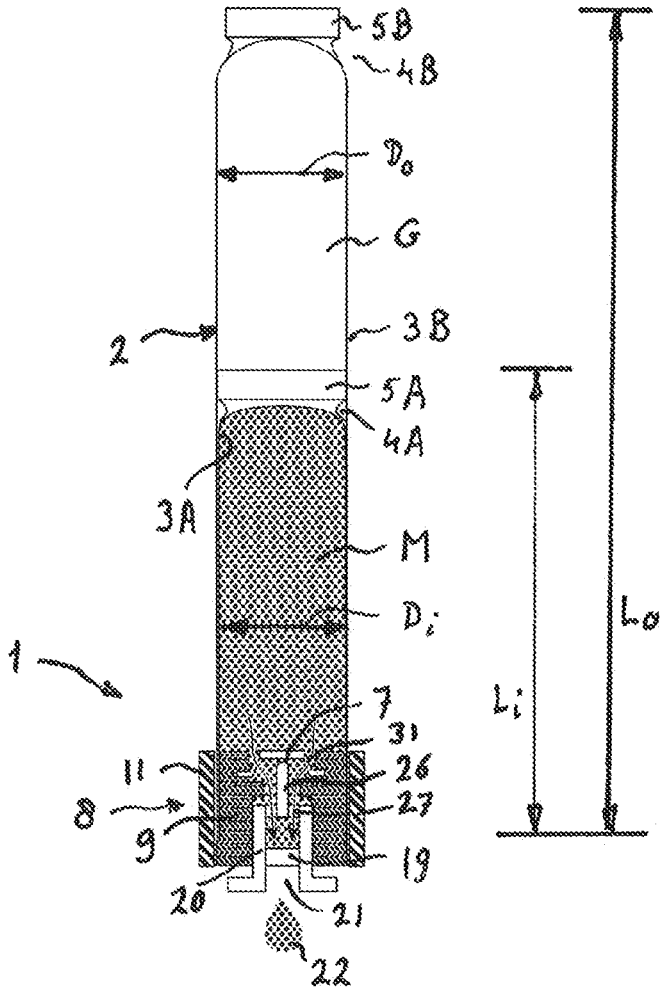
FIG. 12 is a view corresponding with FIG. 8 and showing a further embodiment of the dispensing device in which the material to be dispensed is packed in an inner tubular body that fits tightly in an outer tubular body containing the gas.

In another embodiment having inner and outer tubular bodies 3A, 3B (FIG. 12), the inner tubular body 3A has substantially the same diameter as the outer tubular body 3B ($D_i \neq D_o$), such that it fits tightly and there is no space between the inner and outer tubular bodies 3A, 3B. The ends of the inner and outer tubular bodies 3A, 3B are fixed together between the inner part 9 and the outer part 11 of the sleeve 8. The inner tubular body 3A has a length Li that is smaller than the length Lo of the outer tubular body 3B. In this way the gas G is trapped in the part of the outer tubular body 3B that is left free by the inner tubular body 3A. The gas G exerts pressure on the end 4A of the inner tubular body 3A that is closed by the weld 5A. This pressure results in a force that is directed towards the end closed by the sealing member 7. This embodiment combines the advantages of the slideable piston 15 of FIGS. 3 and 4 with those of the inner and outer tubular bodies 3A, 3B of FIGS. 6-8.

The invention described above provides a simple and low-cost dispensing device having a minimum number of parts, of which only one or two are movable. The dispensing device of the invention may be for single use or may be used repeatedly, and can be easily recycled after its final use. The various parts of the dispensing device may be made of any suitable plastic material, advantageously a flexible plastic material. Preferably, at least the sealing member is made of the same or a similar material as the tubular body, so that the reservoir may be recycled as one. For the same reason it is advantageous if the sleeve and the piston are made of the same or a similar material as the tubular body and the sealing member as well. Preferably, the outlet channel, nozzle and/or applicator are also made of the same or similar materials.

Although various embodiments have been shown and described here, it will be clear that the invention is not limited thereto. For instance, features of different embodiments could be combined into a new embodiment. The inner and outer tubular bodies of the embodiment of FIGS. 6-8 could be tapered, or the tapered reservoir of FIGS. 10 and 11 could include a piston. All embodiments could be provided with either a pierceable diaphragm or a movable valve.

The scope of the invention is defined solely by the following claims.

The invention claimed is:

1. A device for dispensing a material, comprising:

a reservoir for the material and an outlet channel connectable to the reservoir, wherein the reservoir comprises a tubular body partially filled with pressurized gas and is partially filled with the material to be dispensed, wherein one end of the tubular body is welded shut and an opposite end of the tubular body is closed by a sealing member extending over at least part of a cross-sectional area of the tubular body, wherein the sealing member is arranged in a sleeve which is connected to the opposite end of the tubular body opposite the welded end thereof, and wherein the sealing member comprises a movable valve having a peripheral portion that is clamped in an inner part of the sleeve to form a clamping engagement, and the device further comprises an operating member, the valve and the operating member being movable towards each other to permanently remove the valve from the clamping engagement.

2. The device as claimed in claim 1, wherein the sealing member is fixed to the tubular body by clamping, welding, or an adhesive.

3. The device as claimed in claim 1, wherein the sleeve has an inner part supporting the sealing member and is configured to be arranged inside the opposite end of the tubular body opposite the welded end thereof, and an outer part configured to be arranged around the opposite end of the tubular body and to be connected to the inner part.

4. The device as claimed in claim 3, wherein the inner and outer parts of the sleeve are configured to protrude past an edge bounding the opposite end of the tubular body and are also configured to be connected to each other.

5. The device as claimed in claim 1, wherein the outlet channel forms part of a nozzle or applicator that is connectable to the reservoir.

6. The device as claimed in claim 5, wherein the nozzle or applicator is connectable to the sleeve.

7. The device as claimed in claim 1, wherein the pressurized gas in the tubular body is separated from the material to be dispensed.

8. The device as claimed in claim 7, wherein the tubular body comprises an inner tubular body filled with the material to be dispensed, and an outer tubular body surrounding the inner tubular body and filled with the pressurized gas.

9. The device as claimed in claim 8, wherein an annular space is defined between the inner and outer tubular bodies, said annular space being filled with the pressurized gas.

10. The device as claimed in claim 8, wherein the inner tubular body has substantially the same diameter as the outer tubular body, and has a smaller length than the outer tubular body, and wherein the pressurized gas is received in a space between the welded end of the inner tubular body and the welded end of the outer tubular body.

11. The device as claimed in claim 1, wherein the tubular body tapers towards the opposite end that is closed by the sealing member.

12. The device as claimed in claim 1, wherein the tubular body tapers towards the one end that is welded shut.

13. A device for dispensing a material, comprising:

a reservoir for the material and an outlet channel connectable to the reservoir, wherein the reservoir comprises a tubular body partially filled with pressurized gas and is partially filled with the material to be dispensed, wherein one end of the tubular body is welded shut and an opposite end of the tubular body is closed by a sealing member extending over at least part of a cross-sectional area of the tubular body, wherein the sealing member is arranged in a sleeve which is connected to the opposite end of the tubular body opposite the welded end thereof, and wherein the sealing member has a peripheral portion that is clamped in an inner part of the sleeve and the device further comprises an operating member, the sealing member and the operating member being movable towards each other, the sealing member being configured to be permanently removed by being forced out of the clamping engagement by the operating member.

14. The device as claimed in claim 13, wherein the tubular body tapers towards the opposite end that is closed by the sealing member.

15. The device as claimed in claim 13, wherein the tubular body tapers towards the one end that is welded shut.

* * * * *